US007788773B2

(12) United States Patent
Morioka et al.

(10) Patent No.: US 7,788,773 B2
(45) Date of Patent: Sep. 7, 2010

(54) DOUBLE-SIDED ENGAGING ELEMENT FOR SLIDE FASTENER

(75) Inventors: Koitsu Morioka, Toyama-ken (JP); Wataru Yonemichi, Toyama-ken (JP)

(73) Assignee: YKK Corporation (JP)

( * ) Notice: Subject to any disclaimer, the term of this patent is extended or adjusted under 35 U.S.C. 154(b) by 38 days.

(21) Appl. No.: 12/123,618

(22) Filed: May 20, 2008

(65) Prior Publication Data

US 2008/0313867 A1 Dec. 25, 2008

(30) Foreign Application Priority Data

Jun. 20, 2007 (JP) ..... 2007-162769

(51) Int. Cl.
*A44B 19/02* (2006.01)

(52) U.S. Cl. ..... 24/403; 24/409; 24/411

(58) Field of Classification Search ..... 24/403, 24/401, 402, 405, 409, 410, 411, 412, 584.1, 24/585.1, 583.11
See application file for complete search history.

(56) References Cited

U.S. PATENT DOCUMENTS 2,622,295 A * 12/1952 William Mikulas ..... 24/410
2,748,440 A * 6/1956 Frederick Ulrich ..... 24/409
4,004,327 A * 1/1977 Fukuroi et al. ..... 24/411
4,937,922 A * 7/1990 Okazaki ..... 24/403
7,322,075 B2 * 1/2008 Ozaki et al. ..... 24/414

FOREIGN PATENT DOCUMENTS

CN 2669667 Y 1/2005
JP 55-14252 4/1980

* cited by examiner

*Primary Examiner*—Robert J Sandy
*Assistant Examiner*—Rowland D Do
(74) *Attorney, Agent, or Firm*—Kilpatrick Stockton LLP

(57) ABSTRACT

A double-sided engaging element for a slide fastener, comprising a central elevated portion elevated from a coupling base surface; and a pair of right and left projecting portions formed to project from a body portion toward the central elevated portion and to be elevated from the coupling base surface, wherein a central elevated portion of a mating element is detachably coupled in a dent surrounded by the central elevated portion, the right and left projecting portions and a stepped surface. A dimension (T0) between inside elevation startup edges of the right and left projecting portions is set smaller than a dimension (R0) between right and left elevation startup edges of the central elevated portion, and a first missing portion is formed on an outside corner of an end portion of each of the right and left projecting portions opposing the central elevated portion.

6 Claims, 7 Drawing Sheets

DOUBLE-SIDED ENGAGING ELEMENT FOR SLIDE FASTENER

INCORPORATION BY REFERENCE

The present application claims priority under 35 U.S.C. §119 to Japanese Patent Application No. 2007-162769 filed on Jun. 20, 2007. The content of the application is incorporated herein by reference in its entirety.

BACKGROUND OF THE INVENTION

1. Field of the Invention

The present invention relates to a metallic double-sided engaging element for a slide fastener, having coupling surfaces on both front and rear surfaces thereof.

2. Description of the Related Art

To open/close an opening in bags or the like, a slide fastener has been known which can be opened in both ways by disposing two sliders such that the sliders collide with their heads or rear ends. In the slide fastener capable of being opened in both ways, double-sided engaging elements whose front and rear coupling surfaces are formed into an equal shape are used to equalize the feeling of operation in both ways for opening backward and opening in the opposite direction. Particularly, a metallic double-sided engaging element excellent in strength, appearance, durability and flexion property is used for clothes and bags employing strong fabric.

For example, Japanese Utility Model Publication No. 55-14252 has disclosed a device for improving a strength resisting a pushing force from the front and rear surfaces and a coupling strength in a rotation direction with respect to an engagement axial line in a slide fastener using metallic double-sided engaging elements.

The double-sided engaging element for the slide fastener described in Japanese Utility Model Publication No. 55-14252 has a central projecting portion in each central portion of a coupling base surface constituting both the front and rear surfaces of a coupling head main body as seen in its plan view, and includes a pair of right and left leg portions, as seen in the plan view, disposed across an engaging element body portion having a larger thickness than the thickness between the coupling base surfaces continuous from the coupling head main body. Right and left projecting portions which project from the body portion toward the coupling head main body side are elevated from the front and rear coupling base surfaces between the central elevated portion and the engaging element body portion. Here, the outer side face of each of right and left projecting portions is flush with right and left side faces of the engaging element body portion. When coupling the double-sided engaging elements with each other, the central elevated portion of a mating element is fit in a dent between the projecting portions while the front end face of the projecting portion is brought into butting a wide front end face at a mating projecting portion front end. Employing the double-sided engaging element having such a shape improves the strength resisting a pushing force against the slide fastener and the coupling strength in the rotation direction with respect to the engagement axial line.

Further, to improve the sealing performance of the slide fastener using the metallic double-sided engaging elements, a slide fastener employing small double-sided engaging elements has been known as disclosed in for example, CN Utility Model Publication No. 2669667Y.

The double-sided engaging element for the slide fastener described in CN Utility Model Publication No. 2669667Y comprises a thin sheet coupling head main body having coupling base surfaces on both front and rear surfaces thereof as seen in a plan view, a thick body portion extending in one direction from the coupling base surface across a stepped surface, and a pair of leg portions extending from the body portion in a direction opposite to the coupling head main body as seen in a plan view. A central elevated portion is elevated from the central portion of the coupling base surface, and a pair of right and left projecting portions project from the body portion to right and left side faces of the central elevated portion. The pair of central elevated portions of a mating double-sided engaging element are detachably coupled in a dent surrounded by the central elevated portion, the right and left projecting portions and the stepped surface between the upper and lower projecting portions.

In the double-sided engaging element for the slide fastener described in CN Utility Model Publication No. 2669667Y, different from the double-sided engaging element described in Japanese Utility Model Publication No. 55-14252, the outer side face of the right and left projecting portions is formed inside of the upper and lower side faces of the engaging element body portion, so that when the double-sided engaging elements are coupled with each other, they can be bent forward or backward easily.

In the meantime, as for the front and rear surfaces mentioned in this specification, if the surface of one side of the coupling surface of the double-sided engaging element is regarded as the front surface, the surface on the opposite side is called a rear surface. As for the front and rear sides, when the closing side when the double-sided engaging element is opened or closed is regarded as the front side, the releasing side on the opposite side is called a rear side, in order to indicate the direction in which the slider is slid. Further, the right and left sides are both sides with respect to the back and forth direction when the central elevated portion is seen in plan view, and the lateral pulling force refers to a direction of separating the double-sided engaging elements in the coupled state.

In the double-sided engaging element for the slide fastener described in Japanese Utility Model Publication No. 55-14252, a dimension between inside elevation startup edges of the right and left projecting portions at a coupling portion is set substantially equal to a dimension between right and left elevation startup edges of the central elevated portion. The right and left projecting portions and the central elevated portion are inclined in a mountainous shape. With this configuration, when the double-sided engaging elements are coupled with each other, a shift between the double-sided engaging elements in the lateral pulling direction and the right and left direction sometimes might be intensified.

When the double-sided engaging elements are coupled with each other, the wide front end faces at the front end of each of the right and left projecting portions in a coupled state are proximate. As a result, as compared to such a large shift in the right and left direction between the double-sided engaging elements as described above, there is a room for improvement in the flexibility of bending the double-sided engaging elements in engagement in a direction that they overlap each other around a coupling axis line when a pushing force is applied to the slide fastener or the flexibility of twisting the elements with respect to the coupling axis line.

On the other hand, also in the double-sided engaging element of the slide fastener described in CN Utility Model Publication No. 2669667Y, when the double-sided engaging elements are coupled with each other, the front ends of right and left projecting portions parallel to each other become proximate. Thus, the flexibility of bending the double-sided engaging elements in engagement in the direction that they overlap around the coupling axis line when the pushing force is applied to the slide fastener is poor. Further, the flexibility of twisting with respect to the coupling axis line is also poor.

SUMMARY OF THE INVENTION

The present invention has been achieved to solve the problems of the conventional art, and an object of the invention is to provide a double-sided engaging element for a slide fastener in which metallic double-sided engaging elements are attached to a side edge of a fastener tape, the double-sided engaging element having improved flexibility which allows the double-sided engaging elements in engagement to be bent easily around the coupling axis line and twisted easily with respect to the coupling axis line. Another object of the present invention is to provide a double-sided engaging element for a slide fastener having a configuration which disperses a stress applied to a punch die for forming the central elevated portion which is elevated from the coupling head main body of the double-sided engaging element and the right and left projecting portions so as to achieve a long service life of the die.

To achieve the above-described object, the present invention provides a double-sided engaging element for a slide fastener, comprising: a thin sheet coupling head main body having coupling base surfaces on both front and rear surfaces thereof; a thick body portion extending in one direction from each of the coupling base surfaces through a stepped surface; a pair of right and left leg portions extending from the body portion; a central elevated portion which is elevated from a central portion on a front end side of each of the coupling base surfaces; and a pair of right and left projecting portions which are elevated from each of the coupling base surfaces while projecting from the body portion toward each central elevated portion, in which a central elevated portion of a mating element is detachably coupled in a dent surrounded by the central elevated portion, the right and left projecting portions and the stepped surface between the right and left projecting portions, being characterized in that a dimension between inside elevation startup edges of the right and left projecting portions is set smaller than a dimension between right and left elevation startup edges of the central elevated portion, and an outside corner of an end portion of each of the right and left projecting portions opposing the central elevated portion has a first missing portion obtained by eliminating at least an elevation startup edge side thereof.

In the double-sided engaging element for the slide fastener according to the present invention, the dimension between the inside elevation startup edges of the right and left projecting portions projecting from the body portion of the double-sided engaging element is set smaller than the dimension between the right and left elevation startup edges of the central elevated portion which is elevated from the central portion on the front end side of the coupling base surface. With this configuration, the gap between the central elevated portion and each of the right and left projecting portions when the double-sided engaging elements are coupled with each other can be reduced so as to suppress a shift in the direction of the right and left projecting portions of the double-sided engaging elements.

Preferably, the elevation startup edge of the first missing portion comprises a straight line portion, and an interaction angle between a straight line connecting each extreme projecting end of an elevation startup edge at a front end portion of each of the right and left projecting portions and an elevation startup edge of the first missing portion is 5° or more and 45° or less.

The first missing portion whose outside corner portion is eliminated is formed at an end portion of each of the right and left projecting portions on the side opposing the central elevated portion. With this configuration, when a force in a pushing direction is applied to the double-sided engaging elements in engagement, the double-sided engaging elements in engagement can be easy to bend in the direction that they overlap each other around the coupling axis line and the flexibility of twisting with respect to the coupling axis line can be improved. The interaction angle between the straight line connecting the extreme projecting ends of the elevation startup edge at the front end portion of each of the right and left projecting portions and the elevation startup edge of the straight first missing portion is preferred to be set to 5° or more and 45° or less. If this interaction angle is smaller than 5°, it is more difficult to bend the double-sided engaging elements in the direction that they overlap around the coupling axis line, and if the interaction angle is over 45°, the engagement between the double-sided engaging elements becomes easy to release.

Preferably, each elevation startup edge of the central elevated portion has at least one second missing portion for expanding a gap between each elevation startup edge and extreme projecting ends of the right and left projecting portions on right and left corners of the central elevated portion adjacent to each of the extreme projecting ends of the right and left projecting portions. Further, preferably, an elevation startup edge of the second missing portion comprises a straight line portion, the second missing portion starting from more inside of an inner elevation startup edge of each of the right and left projecting portions, and an interaction angle between a straight line, which connects each extreme projecting end of an elevation startup edge at a front end portion of each of the right and left projecting portions, and the elevation startup edge of the second missing portion is set to 5° or more.

The second missing portion is formed on each of right and left corners of the central elevated portion located adjacent to the extreme projecting ends of the right and left projecting portions. In addition, the inclined missing portion is formed in which the interaction angle between the straight line connecting the extreme projecting ends of the elevation startup edge at the front end portion of each of the right and left projecting portions and the elevation startup edge of the straight second missing portion is set smaller than 5°. Consequently, the freedom around the coupling axis line can be intensified and the flexibility of bending the double-sided engaging elements in the direction that they overlap each other and the flexibility of twisting with respect to the coupling axis line can be improved.

According to the present invention, the above-described structure of the double-sided engaging element allows a stress applied to a die when the double-sided engaging element is formed by punching to be dispersed, whereby the service life of a die having a high hardness can be extended and the yield upon forming of the metallic engaging element can be improved. As a result, a high precision, cheap double-sided engaging element can be provided.

DESCRIPTION OF THE PREFERRED EMBODIMENTS

A typical embodiment of a double-sided engaging element of the present invention and a slide fastener using the double-sided engaging element will be described in detail with reference to the accompanying drawings.

Figure 1:
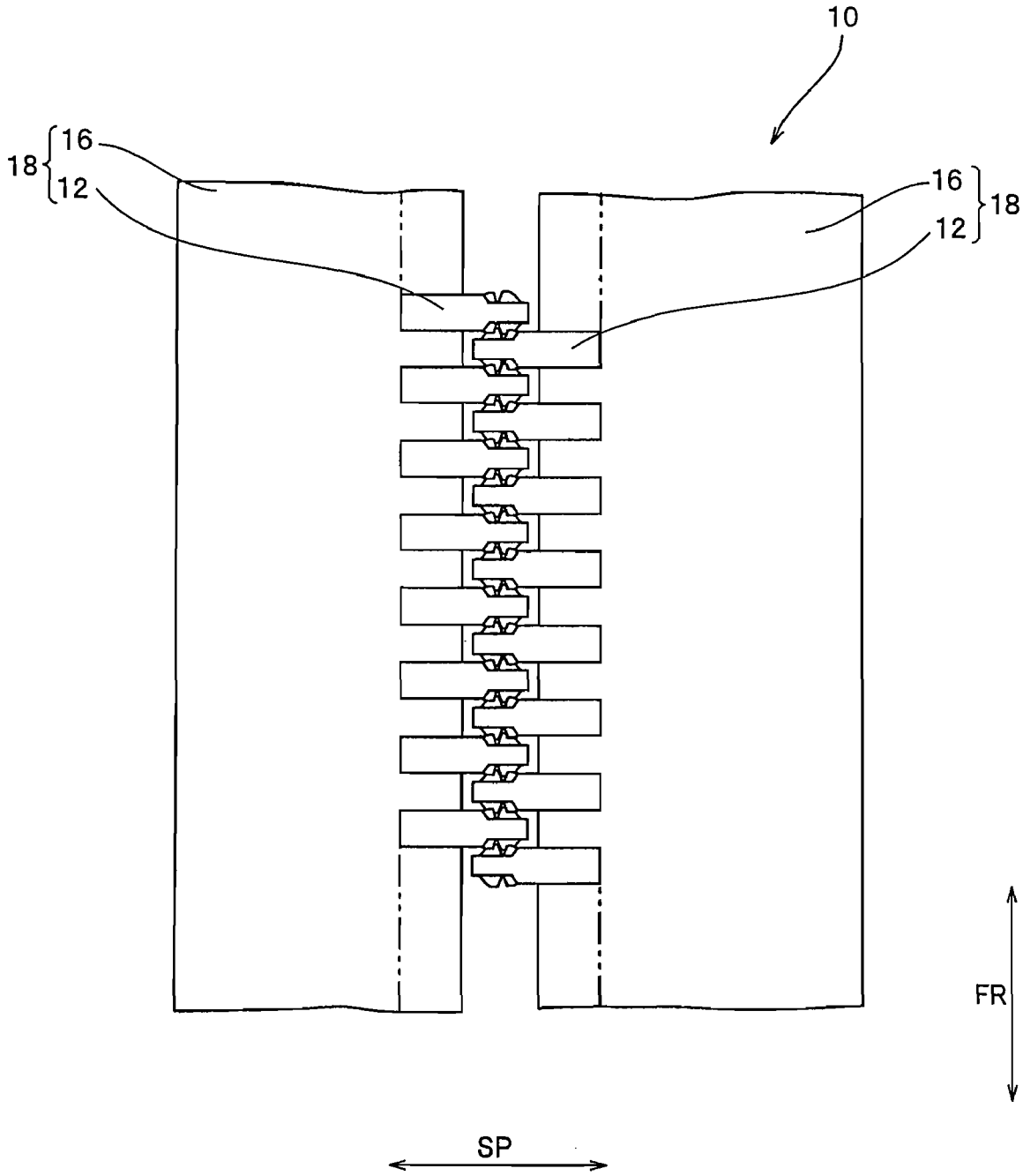
FIG. 1 is a view showing a coupling state of a slide fastener using double-sided engaging elements according to the present invention.
Figure 2:
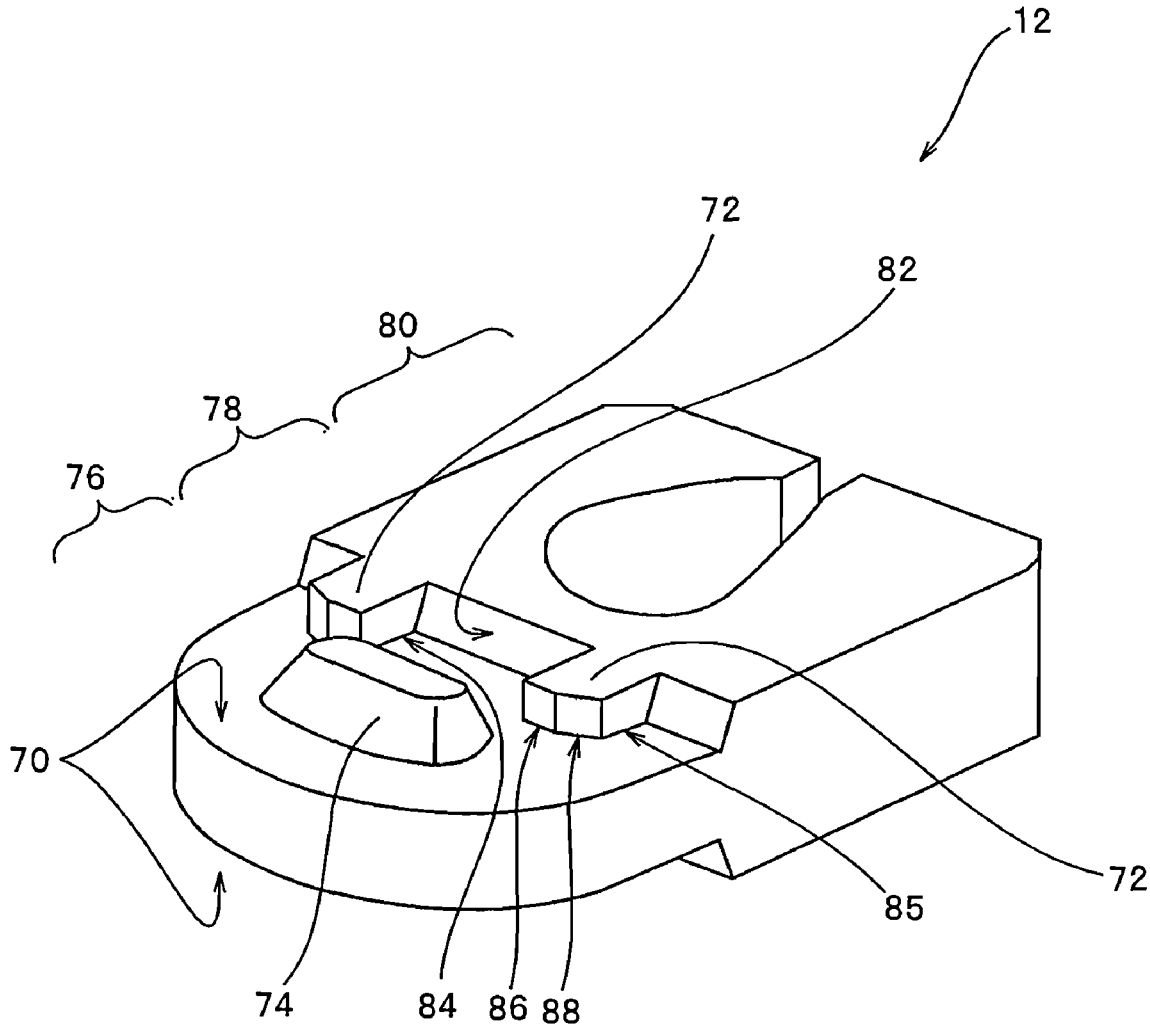
FIG. 2 is a perspective view of the double-sided engaging element attached to a side edge portion of the fastener tape.
Figure 3:
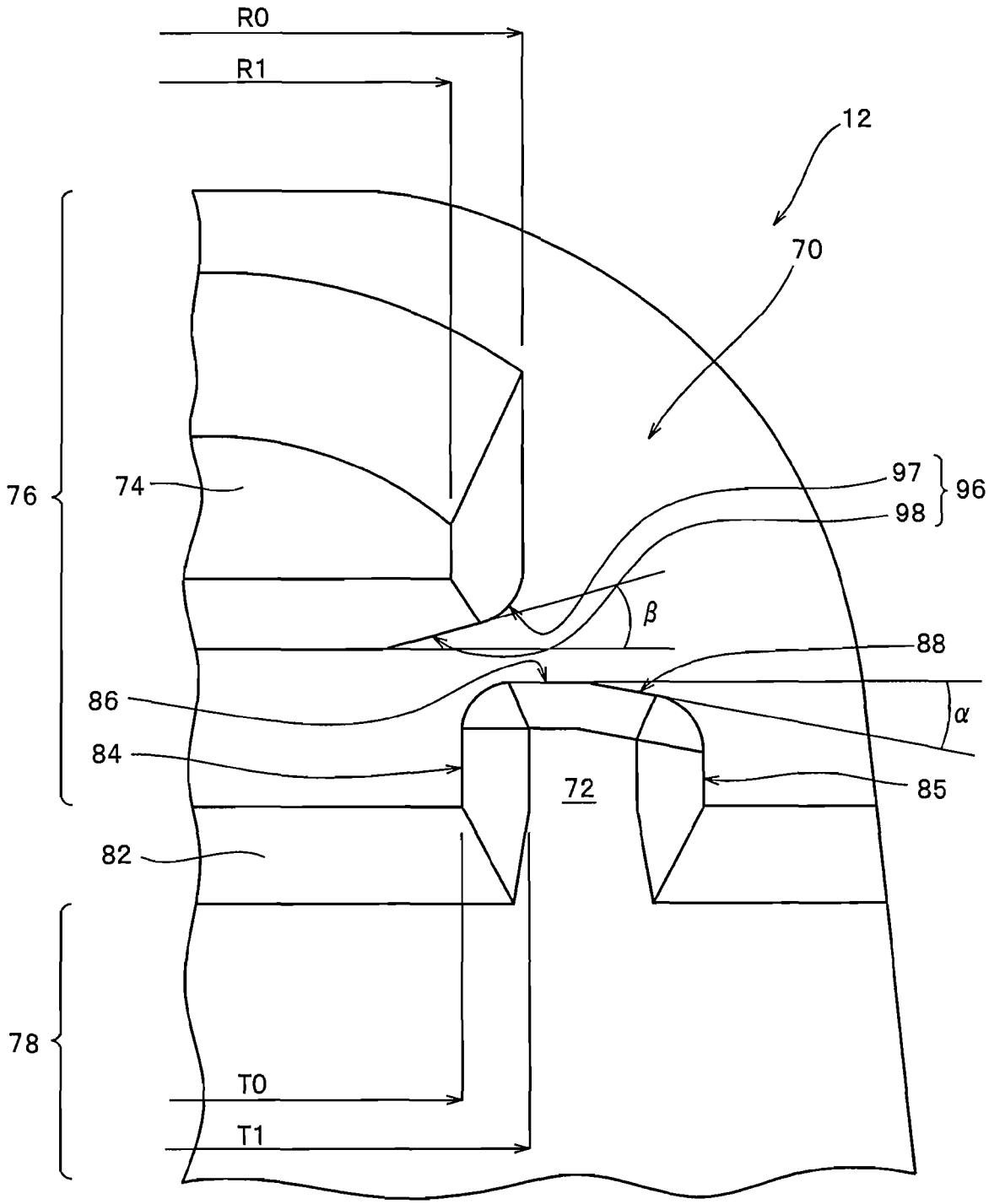
FIG. 3 is an enlarged plan view of a coupling head main body and a body portion of the double-sided engaging element.
Figure 4:
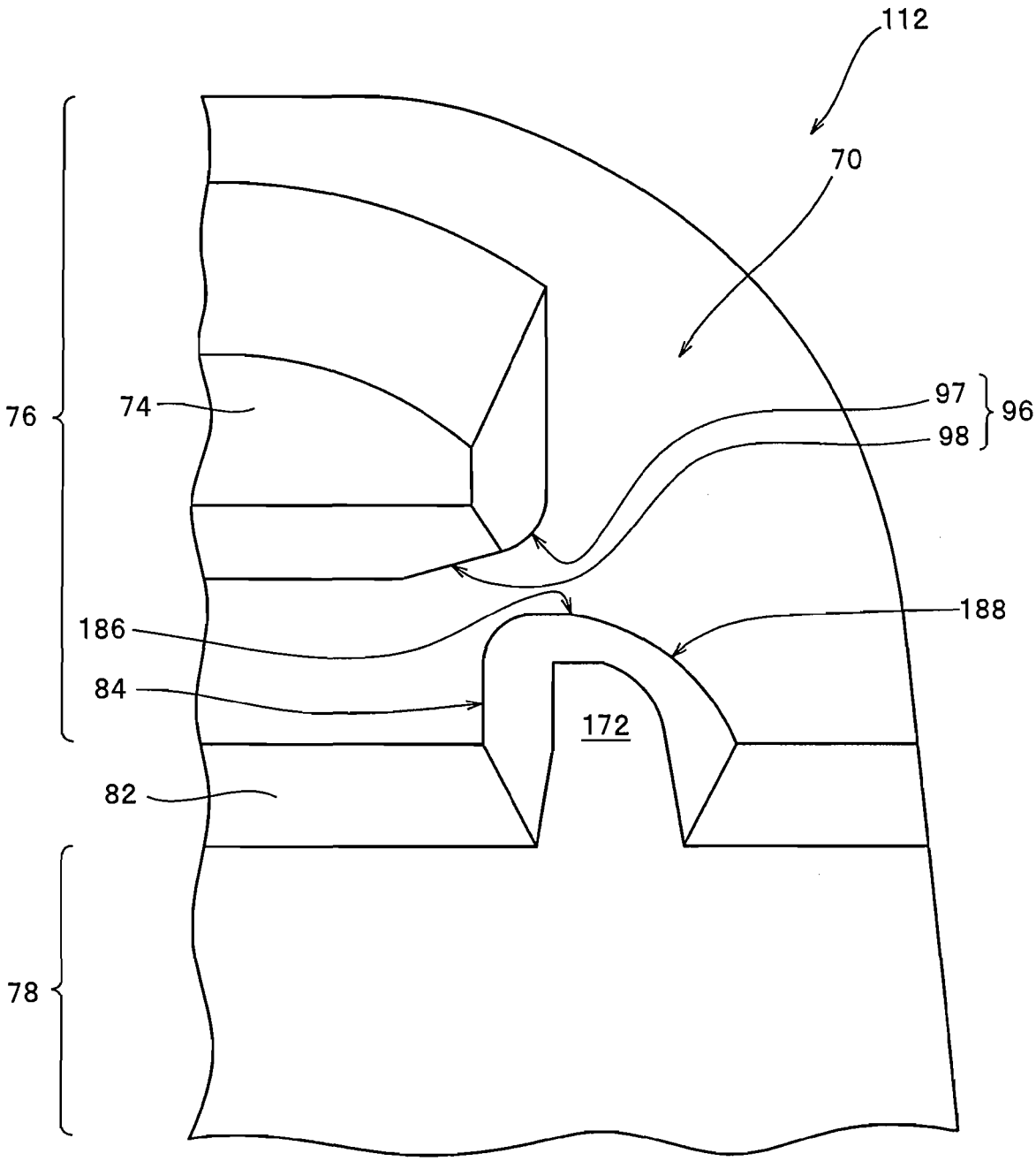
FIG. 4 is an enlarged plan view of the coupling head main body and body portion in the double-sided engaging element having a first missing portion formed in a curve.
Figure 5:
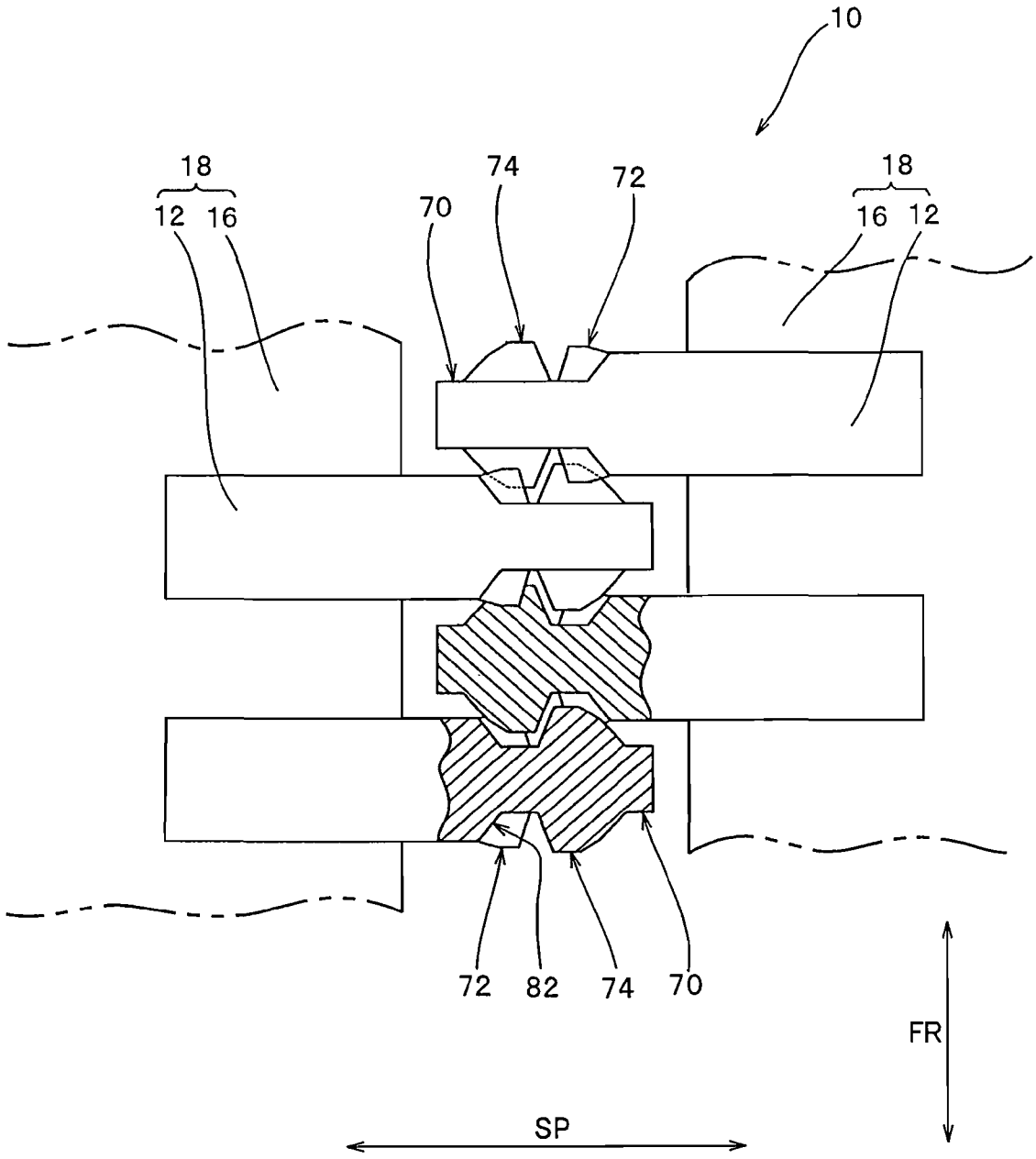
FIG. 5 is an enlarged view of the coupling state of the slide fastener shown in FIG. 1.
Figure 6:
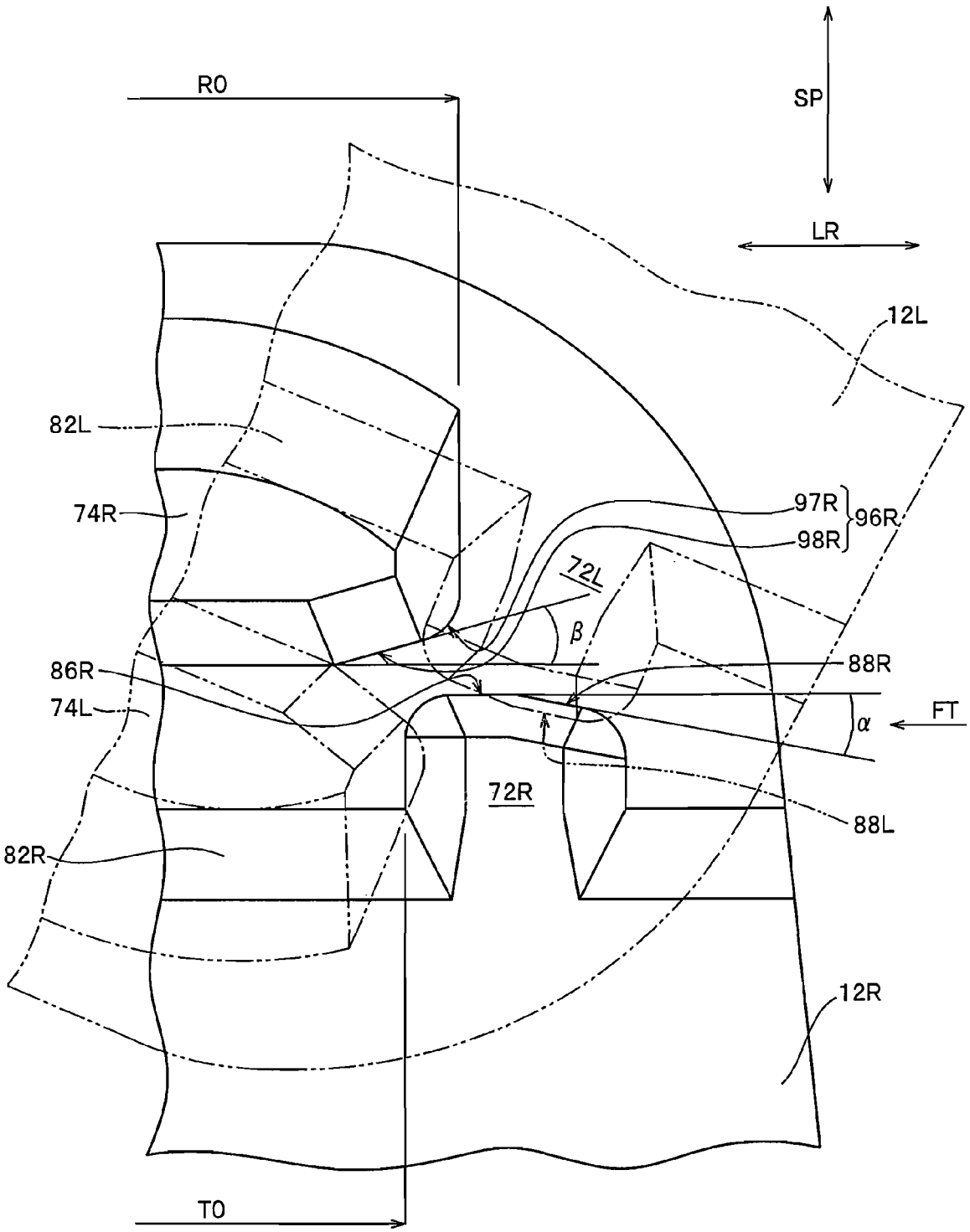
FIG. 6 is a functional explanatory diagram for explaining a state in which the double-sided engaging elements are bent when a pushing force is applied to the double-sided engaging elements in engagement.
Figure 7:
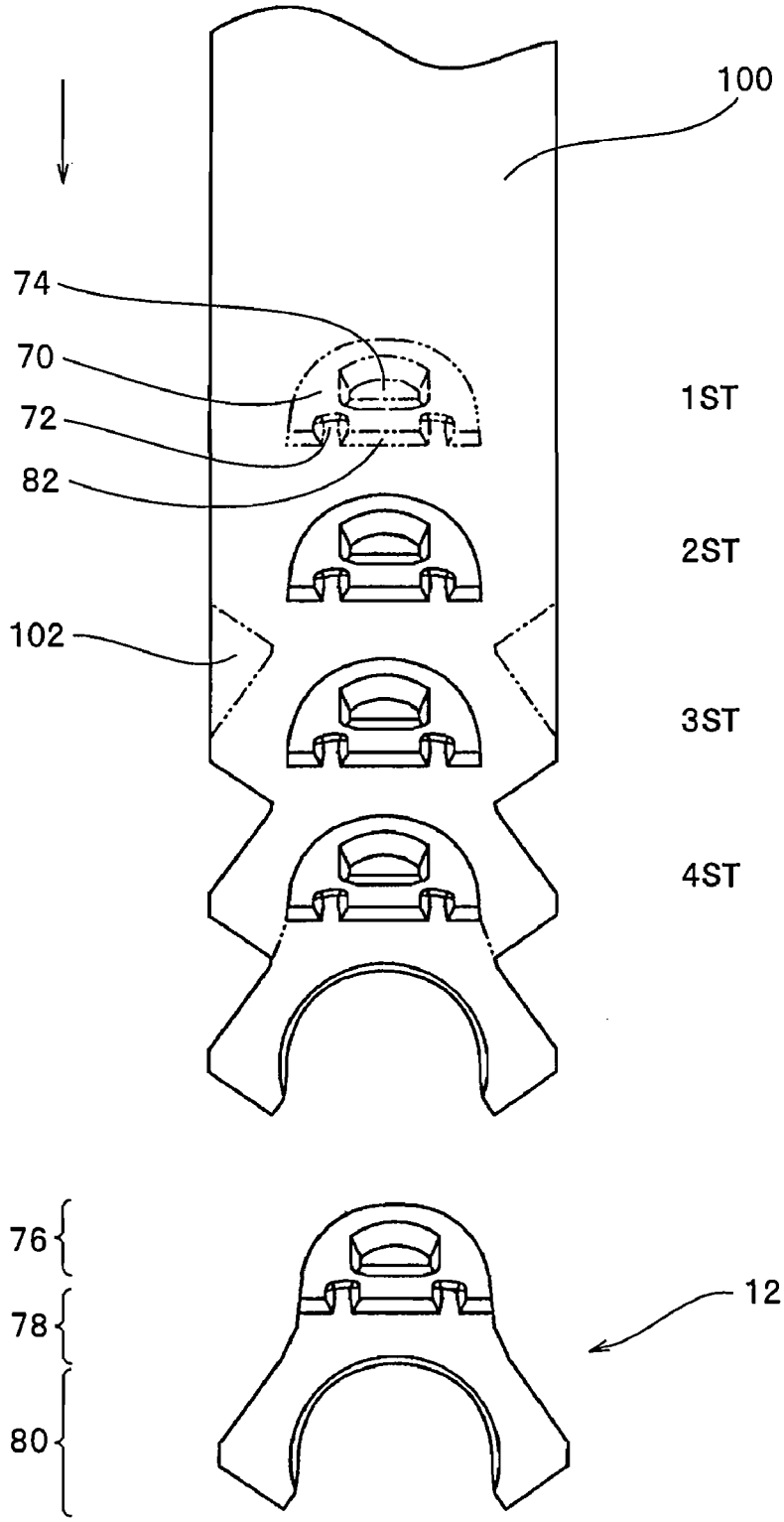
FIG. 7 is a diagram for explaining a manufacturing process when molding the double-sided engaging element from a flat square block.

FIG. 1 is a view showing a coupling state of a slide fastener 10 using double-sided engaging elements 12 according to the present invention, and FIG. 2 is a perspective view of the double-sided engaging element 12 attached to a side edge portion of a fastener tape 16. The configuration of the double-sided engaging element 12 shown in FIG. 2 indicates a state of a component having closed leg portions 80 after the engaging element 12 is attached to the fastener tape 16. The fastener tape 16 is not shown in the figure for convenience for description. FIG. 3 is a plan view showing in which representation of part of the coupling head main body 76 and the body portion 78 of the double-sided engaging element 12 in a locally enlarged manner. FIG. 4 is a view showing an example of a double-sided engaging element 112 having a first missing portion 188 formed in a curve instead of a first missing portion 88 containing a linear portion shown in FIG. 3. FIG. 5 is an enlarged view of the coupling state of the slide fastener 10 shown in FIG. 1. FIG. 6 is a functional explanatory diagram for explaining the flexibility when the double-sided engaging elements 12 are bent with respect to the horizontality in the direction in which the double-sided engaging elements 12 overlap each other around an coupling axis line when a pushing force is applied to the double-sided engaging elements 12 in the coupling state. FIG. 7 is a diagram for explaining a manufacturing process when molding the double-sided engaging element 12 from a flat square block.

As shown in FIG. 1, the slide fastener 10 includes fastener stringers 18 each comprising a fastener tape 16 and metallic double-sided engaging elements 12 attached in line on a side edge portion of the fastener tape 16. The slide fastener 10 shown in FIG. 1 can be used to open the slide fastener 10 in both ways by disposing the sliders for engaging and disengaging the double-sided engaging elements 12 such that the engaging elements 12 meet through their heads or rear ends. Because the double-sided engaging element 12 of the slide fastener 10 is molded such that the front and rear coupling surfaces are symmetrical with respect to the front and rear sides, the feeling of opening/closing the fastener can be equalized regardless of which it is opened in the forward direction or opposite direction. In the meantime, the front and rear sides in this specification refer to the FR direction indicated in FIG. 1, and the lateral pulling direction refers to the SP direction indicated in FIG. 1.

Next, the shape of the double-sided engaging element 12 according to the invention will be described with reference to FIGS. 2 and 3.

As shown in FIGS. 2 and 3, the double-sided engaging element 12 is comprised of a thin sheet coupling head main body 76 having coupling base surfaces 70 on both front and rear sides thereof, a thick body portion 78 extending in one direction from the body portion 78 across a stepped surface 82, and a pair of right and left leg portions 80 having the same thickness as the body portion 78 extending from the body portion 78. A central elevated portion 74 which is elevated in a mountainous shape from the coupling base surface 70 is formed in the central portion on the front end side of the coupling head main body 76.

On the body portion 78 side of the coupling head main body 76, a pair of right and left projecting portions 72 elevated form the coupling base surface 70 are formed so as to project toward the central elevated portion 74 from the body portion 78. When the double-sided engaging elements 12 are coupled with each other, the central elevated portion 74 of a mating element is coupled in a dent surrounded by the central elevated portion 74, the pair of right and left projecting portions 72, and the stepped surface 82.

In order to suppress a shift in the right and left direction (shift in the front and rear direction with respect to a paper sheet in the embodiment shown in FIG. 1) with the double-sided engaging elements 12 of the slide fastener 10 coupled with each other, a dimension T0 between inside elevation startup ends is set smaller than a dimension R0 between right and left elevation startup ends of the central elevated portion 74 as shown in FIG. 3.

If the dimension T0 between the inside elevation startup ends of the right and left projecting portions 72 is set smaller than a dimension R1 between right and left apical edges of the central elevated portion 74, or a dimension T1 between elevated portion apical edges of the right and left projecting portions 72 is set smaller than the dimension R0 between the right and left elevation startup ends of the central elevated portion 74, a clearance is reduced between the dent surrounded by the central elevated portion 74, the pair of right and left projecting portions 72, and the stepped surface 82, and the mating central elevated portion 74. Consequently, the coupled double-sided engaging elements cannot be bent easily in an overlapping direction around the coupling axis line when the pushing force is applied to the slide fastener 10, the flexibility of twisting with respect to the coupling axis line is reduced. Further, there sometimes occurs a fault that the opening or closing of the slide fastener 10 becomes difficult to attain smoothly.

In order to, with the double-sided engaging elements 12 coupled with each other, secure the flexibility upon bending the double-sided engaging elements 12 in the direction that they overlap each other around the coupling axis line and improve the flexibility of twisting with respect to the coupling axis line, the first missing portion 88 is formed by eliminating the outside corner of each of outside elevation startup ends 85 of the right and left projecting portions 72.

Preferably, the first missing portion 88 is configured into a shape containing a linear portion in the outside corner portion of the elevation startup edge, and an intersection angle $\alpha$ between a straight line connecting extreme projecting ends 86 of the right and left projecting portions 72 and the elevation startup edge of the first missing portion 88 (see FIG. 3) is set in a range of 5° or more and 45° or less. For the same reason, it is preferable to form a second missing portion 96 on right and left corners of the central elevated portion 74 adjacent to the extreme projecting ends 86 of the right and left projecting portions 72 in order to expand a gap with respect to the extreme projecting end 86.

Preferably, the second missing portion 96 has a startup point inside of an inside elevation startup edge 84 of the right and left projecting portions 72 and the elevation startup edge of the second missing portion 96 contains a linear portion. Further, it is preferably that an inclined missing portion 98 is formed which forms an angle β with respect to the straight line connecting the extreme projecting ends 86 of the right and left projecting portions 72 (see FIG. 3) is set to 5° or more in order to expand a gap with respect to the extreme projecting end 86, and that a curved portion 97 connecting the inclined missing portion 98 with the central elevated portion 74 is formed. In the meantime, manufacturing process of the double-sided engaging element 12 shown in FIGS. 2 and 3 will be described later with reference to FIG. 7.

Although the first missing portion 88 shown in FIG. 3 presents a shape containing a linear elevation startup edge, the first missing portion 188 may be formed in a curved shape as shown in FIG. 4. As shown in FIG. 4, the central elevated portion 74 which is elevated from the coupling base surface 70 of the coupling head main body 76 includes an inclined missing portion 98, which has a startup point inside of the inside elevation startup edge 84 of the right and left projecting portions 172 and a second missing portion 96 formed of a curved portion 97 connecting the inclined missing portion 98 with both side edges of the central elevated portion 74 with a curve line. Each of the pair of right and left projecting portions 172, which are projected from the body portion 78 toward the central elevated portion 74 while elevated from the coupling base surface 70 has the first missing portion 188 in which the amount of projection of the elevation startup edge decreases in a curved line shape as it departs in the right and left direction in its plan view.

The first missing portion 188 can improve the flexibility of bending and the flexibility of twisting by delaying a contact between the front end faces of the projecting portion 172 when the double-sided engaging elements 12 in engagement are bent in the direction that they overlap around the coupling axis line or twisted with respect to the coupling axis line.

Next, the coupling state of the slide fastener 10 shown in FIG. 1 will be described using the enlarged view with a partial sectional view of FIG. 5.

As shown in FIG. 5, the central elevated portion 74 which is elevated in a mountainous shape from the thin sheet coupling base surface 70 and the pair of right and left projecting portions 72 are formed on both the front and rear surfaces of the double-sided engaging element 12. The central elevated portion 74 of the mating double-sided engaging element 12 invades into a dent surrounded by the central elevated portion 74, the pair of right and left projecting portions 72 and the stepped surface 82, so that the double-sided engaging elements 12 are detachably coupled with each other.

When the mating central elevated portion 74 invades into the dent between the central elevated portion 74 and the stepped surface 82, the double-sided engaging elements 12 are positioned in the lateral pulling direction (SP direction shown in FIG. 5). Further, when the mating central elevated portion 74 invades in between the pair of right and left projecting portions 72 so as to position the double-sided engaging elements 12 in the right and left direction (front and rear surface direction with respect to the paper surface of FIG. 5). In the meantime, the front and rear direction in this specification refers to FR direction shown in FIG. 5, and the lateral pulling direction refers to SP direction shown in FIG. 5.

Next, the flexibility when the pushing force is applied to the double-sided engaging elements 12 of the slide fastener 10 in engagement will be described with reference to FIG. 6.

When a pushing force FT is applied to the double-sided engaging elements 12R, 12L in engagement as shown in FIG. 6, the double-sided engaging element 12R (indicated with solid line) and the double-sided engaging element 12L (indicated with phantom line) are bent in the direction that they overlap around the coupling axis line.

Because a central elevated portion 74L of the mating double-sided engaging element 12L settles in between a central elevated portion 74R of the double-sided engaging element 12R and a stepped surface 82R, the double-sided engaging element 12R and the double-sided engaging element 12L are positioned in the lateral pulling direction (SP direction shown in FIG. 6) of the slide fastener 10. Further, because the central elevated portion 74L of the mating double-sided engaging element 12L settles in between a pair of right and left projecting portions 72R formed on the double-sided engaging element 12R, the double-sided engaging element 12R and the double-sided engaging element 12L are positioned in the right and left direction (LR direction shown in FIG. 6).

In the double-sided engaging elements 12R, 12L of the present invention, the dimension T0 between the inside elevation startup ends of the projecting portions 72R, 72L is set smaller than the dimension R0 between the right and left elevation startup ends of the central elevated portions 74R, 74L. With this configuration, even when the double-sided engaging element 12R and the double-sided engaging element 12L are bent in the direction that they overlap each other around the coupling axis line, the shift in the right and left direction (LR direction shown in FIG. 6) between the double-sided engaging element 12R and the double-sided engaging element 12L in engagement is suppressed, whereby the engagement strength is improved.

The right and left projecting portions 72R, 72L of the double-sided engaging elements 12R, 12L of the invention have the first missing portion 88 formed by eliminating the outside corner. Thus, by delaying a contact between the first missing portions 88R and 88L when the pushing force is applied to the slide fastener 10 with the double-sided engaging element 12R coupled with the double-sided engaging element 12L, the double-sided engaging element 12R and the double-sided engaging element 12L can be bent largely in the direction that they overlap around the coupling axis line.

Preferably, the first missing portion 88R is configured to contain the straight line portion, and the interaction angle α between a straight line connecting the extreme projecting ends 86R of the right and left projecting portions 72R and the elevation startup edge of the first missing portion 88R is set to 5° or more and 45° or less. Consequently, the flexibility of bending around the coupling axis line and the flexibility of twisting with respect to the coupling axis line can be secured while the double-sided engaging elements 12R, 12L are prevented from slipping out. In the meantime, the double-sided engaging element 112 having the curved first missing portion 188 described in FIG. 4 can obtain the same effect.

For the same reason, preferably, a straight inclined missing portion 98R, which forms an angle β of 5° or more with respect to a straight line connecting the extreme projecting ends 86R of the right/left projecting portion 72 in order to expand a gap with respect to the extreme projecting end 86R, is formed at the elevation startup edge on each of right and left corners of the central elevated portion 74R. Further, a curved portion 97R which is curved to connect the inclined missing portion 98R with the central elevated portion 74R is formed.

Next, manufacturing process for molding the double-sided engaging element 12 from a flat square block will be described using FIG. 7.

First, a flat square block 100 having the same thickness as the body portion 78 and the leg portion 80 of the double-sided engaging element 12 is fed from up to down intermittently in FIG. 7. First in a first process (1ST), the coupling base surface 70, the central elevated portion 74, the pair of right and left projecting portions 72, and the stepped surf ace 82 of the coupling head main body 76 are molded using a double sided punch formed symmetrically to the respective parts. Thereafter, an interval of several pitches is fed (2ST) and in the next third process (3ST), an unnecessary portion 102 is cut from the bottom portion and side portion of the leg portion 80.

In the next fourth process (4ST), the coupling head main body 76 and the body portion 78 of the double-sided engaging element 12 are cut out integrally so as to obtain a double-sided engaging element 12 located at the extreme end. In the meantime, at the same time when the double-sided engaging element 12 is cut out from the flat square block 100 in the fourth process, one side edge of the fastener tape 16 is disposed between the pair of leg portions 80. Then, the leg portions 80 are deformed inward so as to attach the double-sided engaging element 12 to the side edge portion of the fastener tape 16. In the example shown in FIG. 7, the outer shape of the coupling head main body 76 and the inner shape of the leg portion 80 are equalized to improve the yield of the flat square block 100 in the example shown in FIG. 7.

In the first process and second process, a stress might be concentrated to the thin portion of a punching die, in particular, a portion for molding a base surface in which the central elevated portion 74 and the projecting portion 72 are most proximate to each other when the front and rear surfaces of the coupling head main body 76 are formed. Thus, it is considered that part of the die may be broken due to fatigue after punching operations are executed several hundreds of thousands times. Then, by forming the portion to which a stress is easy to concentrate in the die in a thick configuration to disperse the stress, the service life can be extended to stabilize the accuracy of the metallic double-sided engaging element 12 in a long term and manufacturing cost of the metallic double-sided engaging element 12 can be reduced.

For example, in the coupling head main body 76 shown in FIG. 3, it is effective to form the first missing portion 88 by eliminating the outside corner portion of the right/left projecting portion 72 to increase a gap between the curved portion 97 of the central elevated portion 74 and the first missing portion 88 as much as possible, so that the elevation startup edge for forming the first missing portion 88 is released not to be directed to the central elevated portion 74. Further, by forming the straight inclined missing portion 98 on the elevation startup edge of the central elevated portion 74 to form the curved portion 97 connecting the inclined missing portion 98 with the both side edges of the elevation startup edges of the central elevated portion 74, the gap between the curved portion 97 of the central elevated portion 74 and the first missing portion 88 can be increased. By specifying the configuration of the double-sided engaging element 12, it is possible to prevent generation of a crack which might occur in a section from the curved portion 97 up to the first missing portion 88 due to a die without changing the coupling dimension between the dent surrounded by the central elevated portion 74, the pair of right and left projecting portions 72, and the stepped surface 82, and the central elevated portion 74 or without lowering the engagement strength between the engaging elements.

Further, the second missing portion 96 for expanding the gap with respect to the extreme projecting end 86 of the right and left projecting portions 72 is formed on the right and left corners of the central elevated portion 74, whereby the gap between the central elevated portion 74 and the projecting portion 72 can be increased to prevent the crack which might be generated on a border between the central elevated portion 74 and the projecting portion 72 of the die.

The slide fastener having the double-sided engaging elements of the invention can be applied to, for example, clothes and bags composed of thick fabric, such as denim, leather and synthetic leather. Because the slide fastener of the invention has flexibility of bending around the coupling axis line and flexibility of twisting with respect to the coupling axis line, it can be operated to open in a forward direction or in an opposite direction even when the slide fastener is bent.

What is claimed is:

1. A double-sided engaging element for a slide fastener, comprising:

a thin sheet coupling head main body having coupling base surfaces on both front and rear surfaces thereof;

a thick body portion extending in one direction from each of the coupling base surfaces through a stepped surface;

a pair of right and left leg portions extending from the body portion;

a central elevated portion which is elevated from a central portion on a front end side of each of the coupling base surfaces; and a pair of right and left projecting portions which are elevated from each of the coupling base surfaces while projecting from the body portion toward each central elevated portion, in which a central elevated portion of a mating element is detachably coupled in a dent surrounded by the central elevated portion, the right and left projecting portions and the stepped surface between the right and left projecting portions, wherein a dimension (TO) between inside elevation startup edges of each of the right and left projecting portions is set smaller than a dimension (RO) between right and left elevation startup edges of the central elevated portion, and an outside corner of an end portion of each of the right and left projecting portions opposing the central elevated portion has a first missing portion so that an outside edge of each of the right and left projecting portion tapers at a greater rate than a respective inside edge of the each of the right and left projecting portions.

2. The double-sided engaging element for the slide fastener according to claim 1, wherein an elevation startup edge of the first missing portion comprises a straight line portion, and an interaction angle ($\alpha$) between a straight line connecting each extreme projecting end of an elevation startup edge at a front end portion of each of the right and left projecting portions and the elevation startup edge of the first missing portion is 5° or more and 45° or less.

3. The double-sided engaging element for the slide fastener according to claim 1, wherein right and left corners of the central elevated portion opposing inside corners of extreme projecting ends of each of the right and left projecting portion has a second missing portion obtained by eliminating each elevation startup edge side thereof for expanding a gap between each elevation startup edge and the extreme projecting ends of the right and left projecting portions on the right and left corners of the central elevated portion.

4. The double-sided engaging element for the slide fastener according to claim 2, wherein right and left corners of the central elevated portion opposing inside corners of extreme projecting ends of each of the right and left projecting portions has a second missing portion obtained by eliminating each elevation startup edge side thereof for expanding a gap between each elevation startup edge and the extreme projecting ends of the right and left projecting portions on the right and left corners of the central elevated portion.

5. The double-sided engaging element for the slide fastener according to claim 3, wherein an elevation startup edge of the second missing portion comprises a straight line portion, the second missing portion starting from more inside of an inner elevation startup edge of each of the right and left projecting portions, and the second missing portion comprises an inclined missing portion for expanding a gap with respect to the projecting portions by setting an interaction angle (β) between a straight line, which connects each extreme projecting end of an elevation startup edge at a front end portion of each of the right and left projecting portions, and the elevation startup edge of the second missing portion to 5° or more.

6. The double-sided engaging element for the slide fastener according to claim 4, wherein an elevation startup edge of the second missing portion comprises a straight line portion, the second missing portion starting from more inside of an inner elevation startup edge of each of the right and left projecting portions, and the second missing portion comprises an inclined missing portion for expanding a gap with respect to the projecting portions by setting an interaction angle (β) between a straight line, which connects each extreme projecting end of an elevation startup edge at a front end portion of each of the right and left projecting portions, and the elevation startup edge of the second missing portion to 5° or more.

* * * * *